US005316373A

United States Patent [19]

Markel

[11] Patent Number: 5,316,373

[45] Date of Patent: May 31, 1994

[54] SEAT ARM REST

[75] Inventor: David I. Markel, Elkhart, Ind.

[73] Assignee: Voyager, Inc., Elkhart, Ind.

[21] Appl. No.: 13,359

[22] Filed: Feb. 4, 1993

[51] Int. Cl.[5] ..... A47C 7/54

[52] U.S. Cl. ..... 297/411.32; 16/266; 16/375; 403/112; 297/411.26

[58] Field of Search ..... 403/112, 113, 116, 117; 16/374, 375, 254, 260, 266; 297/115, 116, 416, 417; 248/118, 289.1

[56] References Cited

U.S. PATENT DOCUMENTS 2,412,395 12/1946 Goosmann ..... 16/266 X
2,498,557 2/1950 Lantz ..... 16/374
3,549,182 12/1970 Bogue et al. ..... 403/112
4,067,613 1/1978 Pesiri ..... 297/417 X
4,707,032 11/1987 Chang ..... 297/417 X
5,056,868 10/1991 Beck ..... 297/417
5,088,791 2/1992 Comley et al. ..... 297/417

*Primary Examiner*—Clifford D. Crowder
*Assistant Examiner*—John J. Calvert
*Attorney, Agent, or Firm*—Thomas J. Dodd; James D. Hall

[57] ABSTRACT

A flip-up arm rest for a chair or other seating. The arm rest is rotatably connected to a control housing through a connecting rod. The control housing includes a central passage to accommodate a control pin which extends from the connecting rod. A stop pin is housed in a passage which communicates with the central passage and serves to limit rotation movement of the arm rest.

2 Claims, 6 Drawing Sheets

SEAT ARM REST

SUMMARY OF THE INVENTION

This invention relates to arm rests and will have special application to shiftable arm rests as used in seating.

Typically, flip-up seat arm rests include a connecting rod which secures the arm rest to the chair frame. The chair frame typically includes stops which serve to limit the rotational travel of the arm rest between full up and full down positions.

The arm rest of this invention obviates the need to incorporate the stops into the chair frame. The arm rest includes a control housing positioned in the chair frame which accepts the connecting rod and houses the rod during rotational movement of the arm. The control housing includes a stop pin housed in a channel oriented transversely to and in communication with a central channel which houses the guide pin attached to the connecting rod. The orientation of the interconnecting channels allows the stop pin to limit rotational movement of the arm, and also allows the arm to be detached from the control housing as necessary.

Accordingly, it is an object of this invention to provide for a novel flip-up seat arm rest.

Another object is to provide for a seat arm rest construction which is easier to repair and maintain.

Another object is to provide for a seat arm rest construction which is efficient, economical and more aesthetically attractive.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
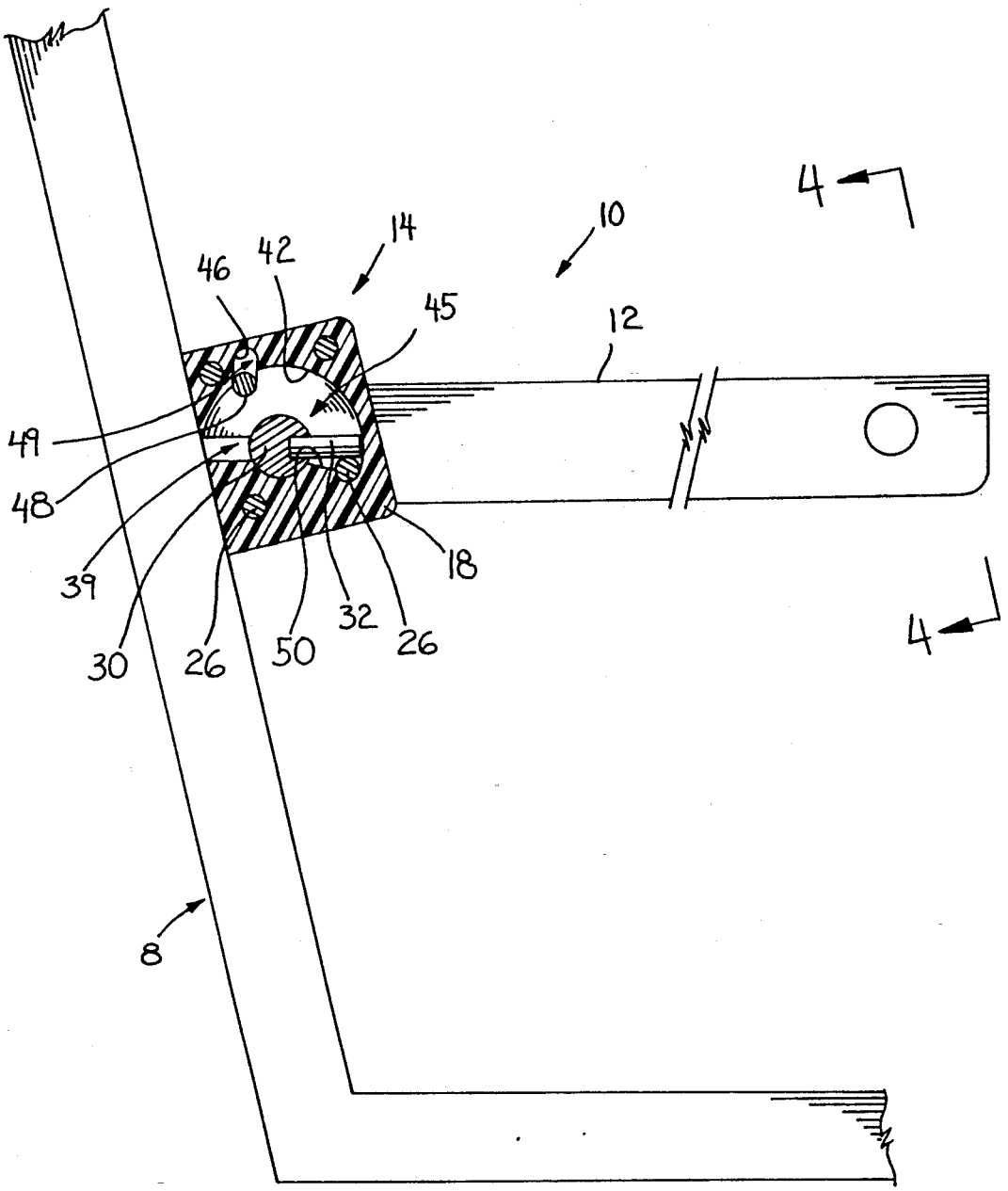
FIG. 1 is an end elevation view of the arm rest of this invention with the arm shown in the full down position and portions of the control housing shown in section form.

The preferred embodiment herein described is not intended to be exhaustive or to limit the invention to the precise form disclosed. It is chosen and described to explain the principles of the invention and its application and practical use to enable others skilled in the art to utilize its teachings.

Referring to the drawings, reference numeral 10 generally designates the seat arm rest of this invention. Arm rest 10 is generally adapted to be used in conjunction with seats, particularly vehicular seating, although other uses are no doubt possible, and the intention is not to limit the invention to a specific use or uses.

Arm rest 10 includes generally an arm support 12 and a control housing 14. Arm support 12 is a conventional item well-known in the art and may be formed of metal, fiberglass, plastic or the like. Normally, arm support 12 is covered by a decorative fabric material (not shown) which matches the color scheme of the fabric covered seat (not shown).

Figure 7:
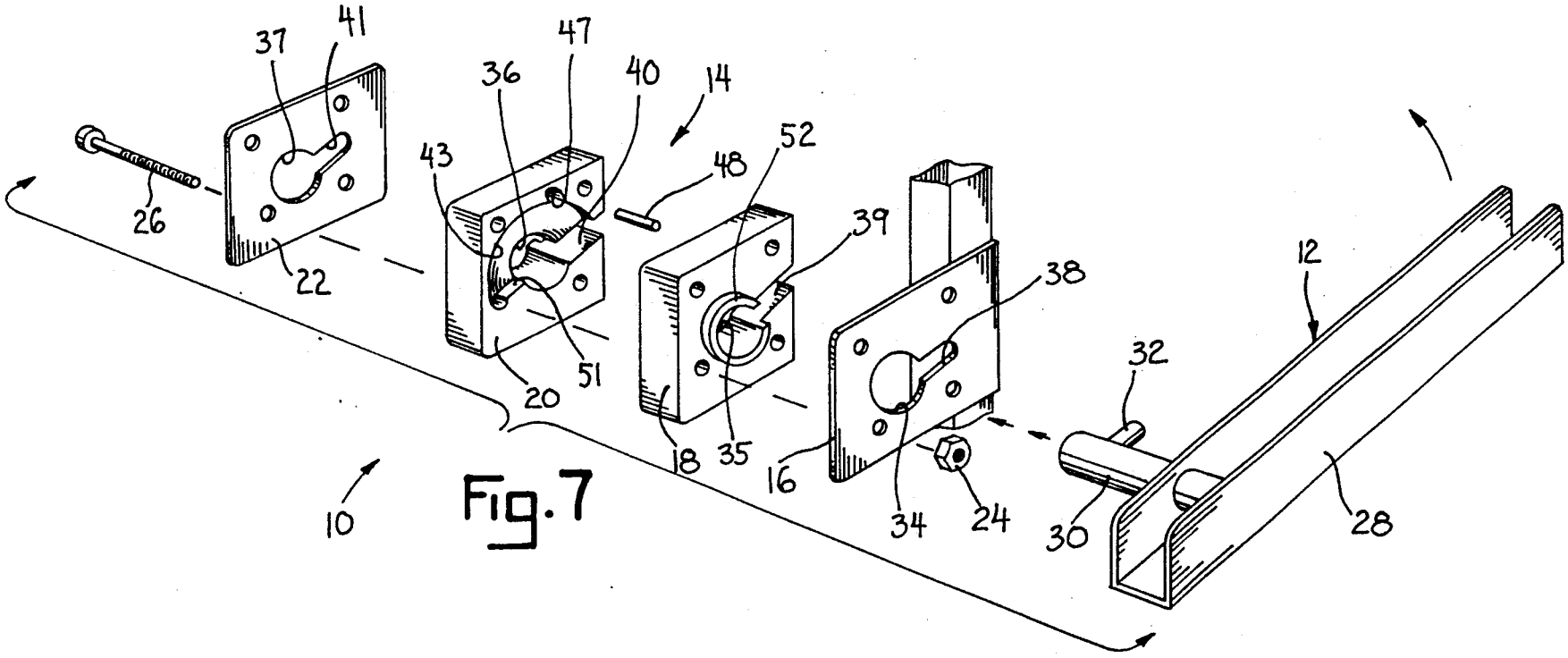
FIG. 7 is an exploded view of the arm rest.

Control housing 14 is generally adapted for removable connection to a seat frame 8 in a conventional manner. Control housing 14, as shown in FIG. 7, preferably includes outer cover plate 16, guide blocks 18, 20 and inner cover plate 22. Plates 16, 22 and guide blocks 18, 20 are preferably secured together by fasteners such as nuts 24 and bolts 26 (one of each shown).

Arm support 12 may be of any common shape and for illustration is shown as a U-shaped bar 28 which includes a mounting rod 30. Guide pin 32 extends from mounting rod 30 as shown.

Each cover plate 16, 22 and blocks 18, 20 defines an aligned hole 34–37 respectively which further defines elongated slot 38–41 respectively to accommodate ingress and egress of rod 30 and pin 32. Block 18 defines an outer generally semi-circular recess 42 and block 20 defines a generally semi-circular recess 43 which is complemental to recess 42. When joined, recesses 42, 43 of blocks 18, 20 define a central guide passage 45 for pin 32 to allow limited rotation of arm support 12 relative to frame 8.

Block 18 further defines detent 46 which communicates with recess 42 and block 20 further defines detent 47 which communicates with recess 43. Stop pin 48 is positioned in detents 46, 47 such that when blocks 18, 20 are joined, pin 48 rides in the groove 49 formed by the detents. Downward movement of pin 48 is limited by contact with bolts 26 or with block shoulders 50, 51 respectively. Each block 18, 20 may further define protruding flange 52, 53 as shown which protrudes through cover plates 16, 22.

Arm rest 10 is preferably assembled and operated as follows. Guide blocks 18, 20 are positioned adjacent to seat frame 8 and cover plates 16, 22 are positioned adjacent the blocks with flanges 52, 53 protruding through holes 34, 37. Cover plates 16, 22 are then connected to seat frame 8 as by welding. Guide blocks 18, 20 are then secured to cover plates 16, 22 by nuts 24 and bolts 26.

Seat frame 8 is then inverted to allow stop pin 48 to fall by gravity into groove 49 of detents 46, 47. Arm support 12 may then be affixed by inverting rod 30 and pin 32 through holes 34–37 and slots 38–41 until the pin 32 contacts recess surface 44. Arm support 12 is then rotated in guide passages 45 and seat frame 8 is reinverted into its common upright position. This allows stop pin 48 to fall by gravity into slots 39, 40 to block those slots and prevent withdrawal of arm support 12.

Figure 2:
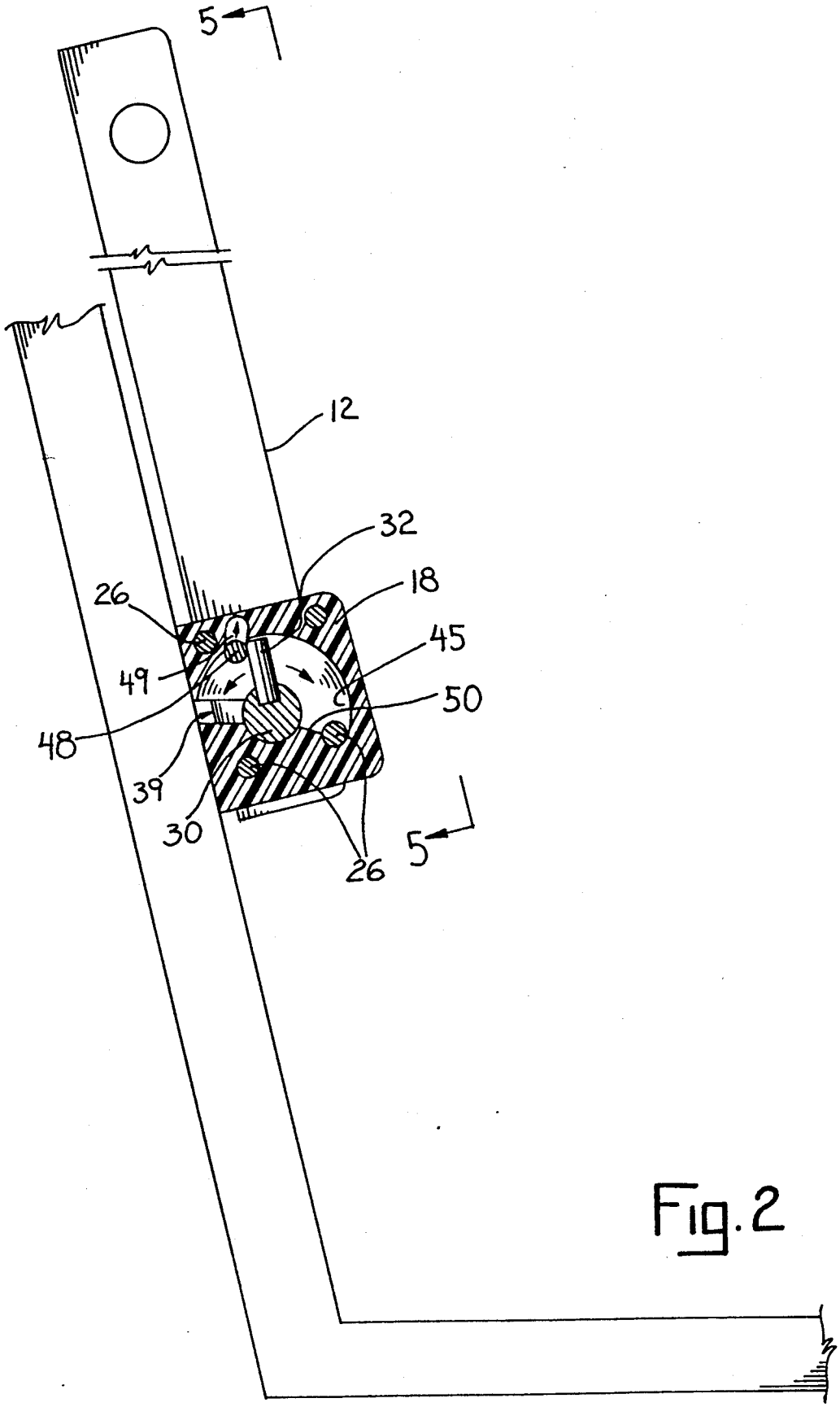
FIG. 2 is an end elevation view of the arm rest showing the arm in a full up position.
Figure 3:
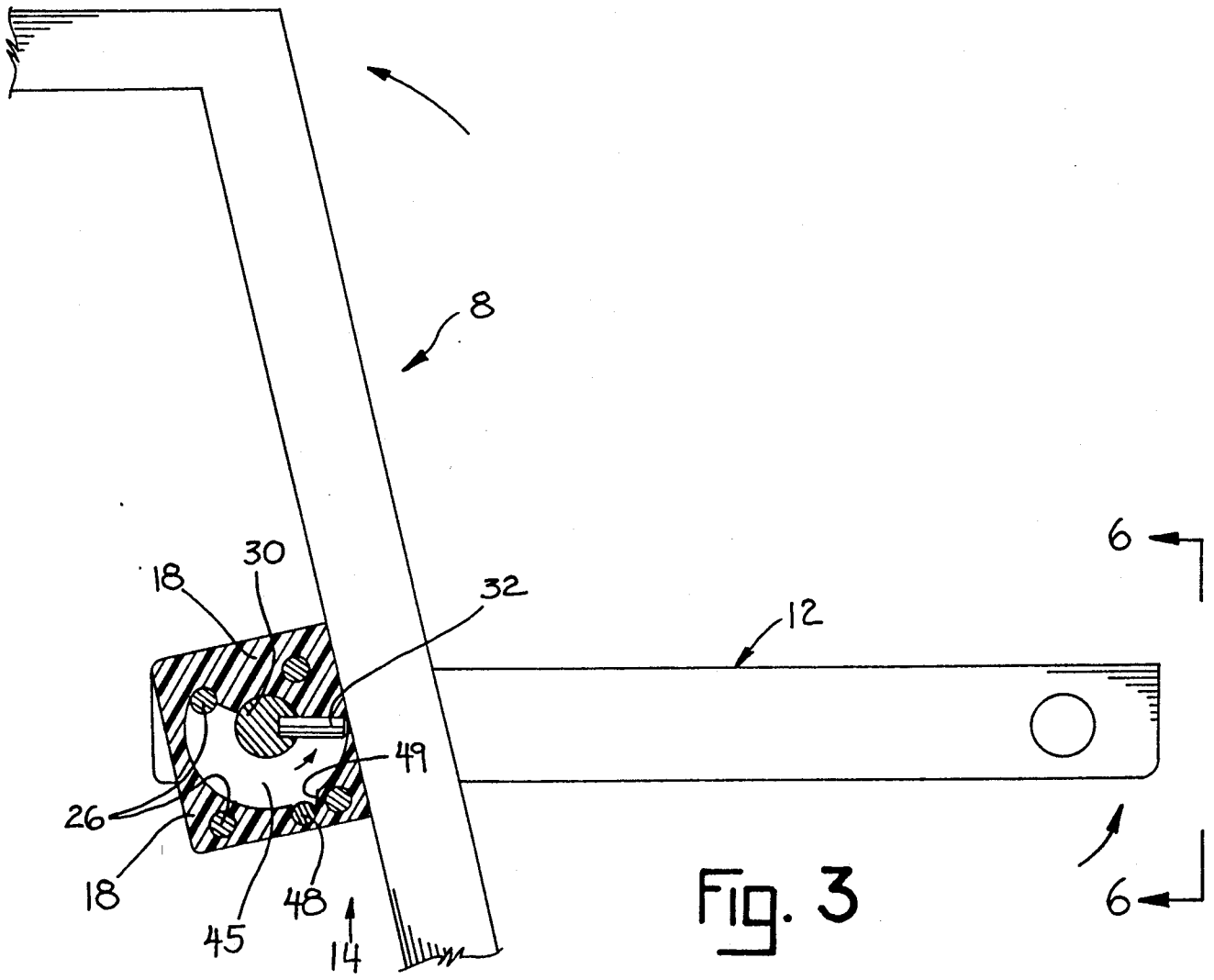
FIG. 3 is an end view of the arm rest in the inverted release position.
Figure 6:
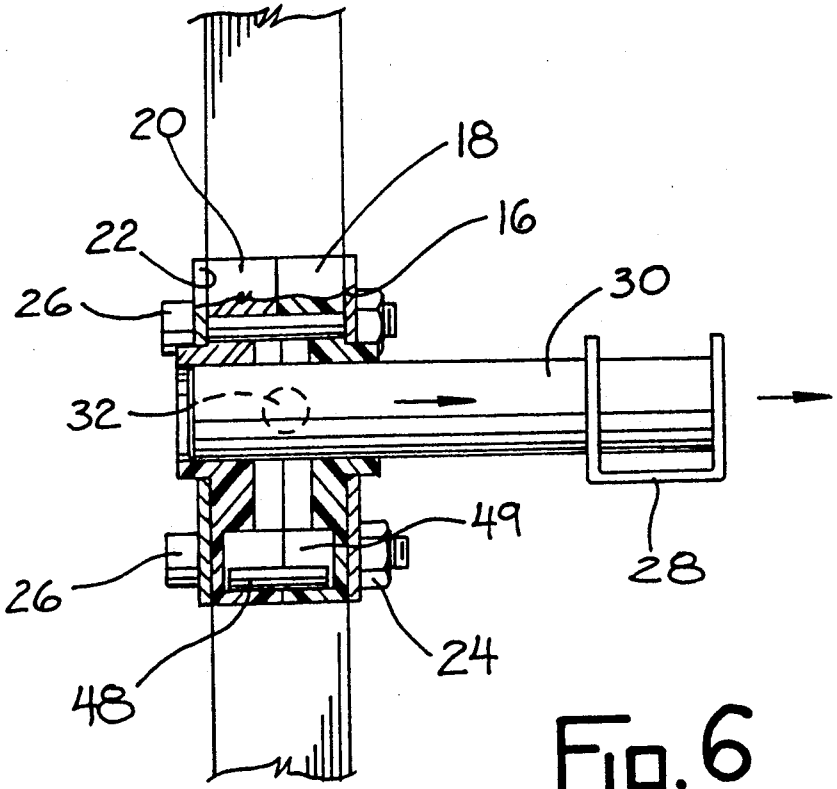
FIG. 6 is a front elevation view taken along line 3—3 of FIG. 3 showing the operation of inserting or removing the connecting rod from the control housing.
Figure 4:
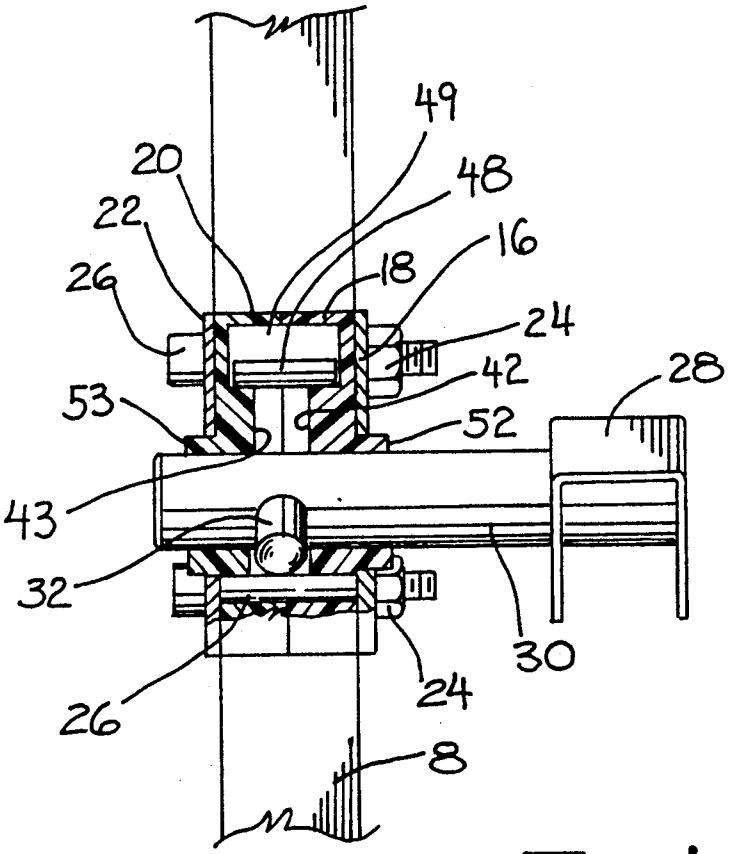
FIG. 4 is a front elevation view of the arm rest taken along line 4—4 of FIG. 1.
Figure 5:
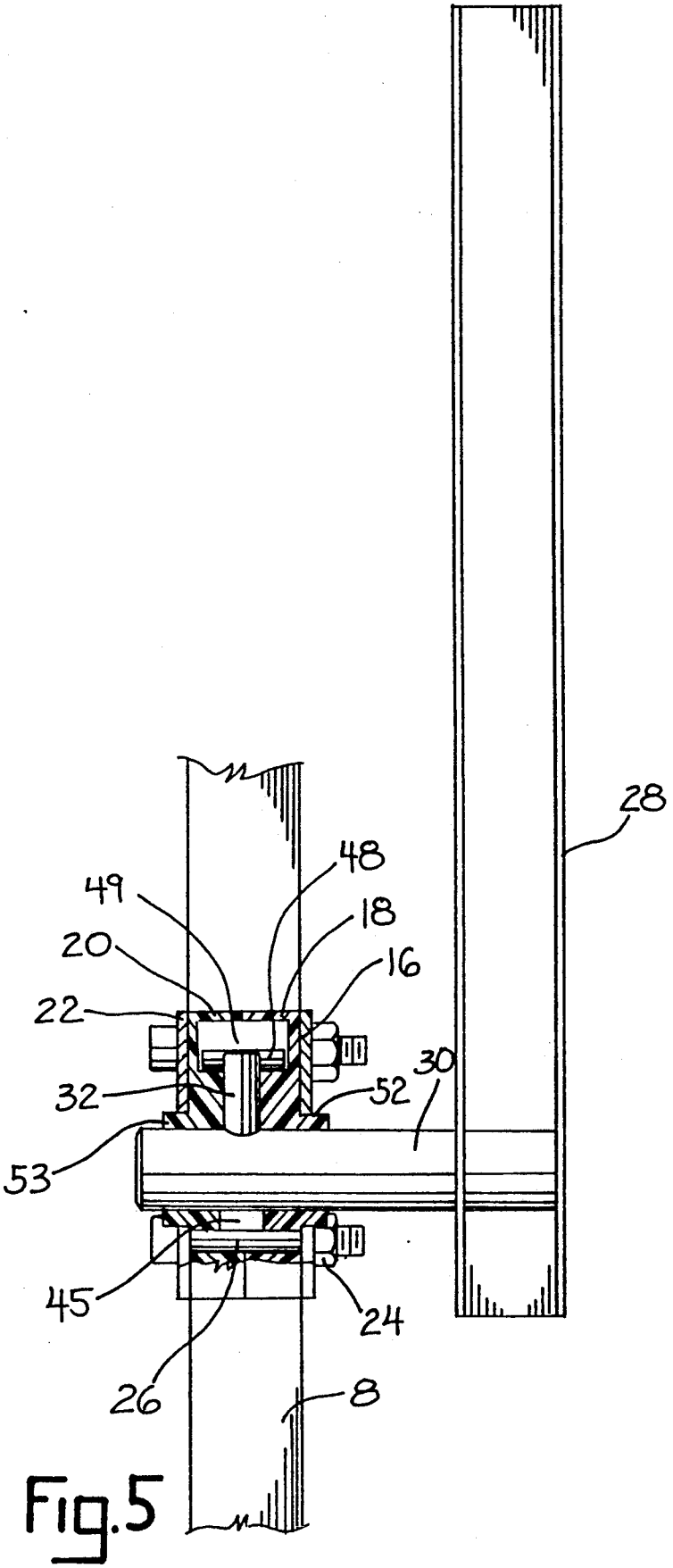
FIG. 5 is a front detail elevation view taken along line 5—5 of FIG. 2.

To remove arm support 12 for any reason, seat frame 8 must be inverted from the position of FIGS. 1 and 2 into the position shown in FIG. 3. This allows stop pin to return to groove 49 by gravity. This removes the blocking member from slots 39, 40 and allows arm support 12 to be rotated until pin 32 is aligned with slots 38–41 for withdrawal.

It is understood that the above description does not limit the invention to the details given, but may be modified within the scope of the following claims.

We claim:

1. An arm support for a seat, said arm support comprising a control housing adapted for mounting to a seat, said control housing defined by inner and outer faces and an end face, a throughbore extending between said inner and outer faces, a first slotted passage defined in said housing oriented transverse of said throughbore and communicating therewith, a second slotted passage defined in said housing spaced from and generally coaxial with the throughbore, said second slotted passage partially communicating with the first slotted passage, a stop pin shiftably housed in said second slotted passage between a first position not in communication with said first slotted passage, and a second position interrupting said first slotted passage, said arm support further including an arm rest having a connecting rod, said connecting rod extending into said throughbore, a guide pin fastened to said connecting rod and radially shiftably fitted in said first slotted passage between a generally horizontal down position and a generally vertical raised position, said stop pin in said second position constituting means for limiting movement of said guide pin and arm rest towards said raised position.

2. The arm support of claim 1 and a third slotted passage in communication with said first slotted passage and spaced from said second slotted passage wherein insertion of said guide pin into said control housing is facilitated.

* * * * *